US008579595B2

(12) United States Patent
Cho

(10) Patent No.: US 8,579,595 B2
(45) Date of Patent: Nov. 12, 2013

(54) COOLING DEVICE FOR CONSTRUCTION MACHINERY

(75) Inventor: Yun Su Cho, Incheon (KR)

(73) Assignee: Doosan Infracore Co., Ltd., Incheon (KR)

( * ) Notice: Subject to any disclaimer, the term of this patent is extended or adjusted under 35 U.S.C. 154(b) by 153 days.

(21) Appl. No.: 13/140,524

(22) PCT Filed: Dec. 18, 2009

(86) PCT No.: PCT/KR2009/007583

§ 371 (c)(1),
(2), (4) Date: Jun. 17, 2011

(87) PCT Pub. No.: WO2010/071377

PCT Pub. Date: Jun. 24, 2010

(65) Prior Publication Data

US 2012/0057989 A1 Mar. 8, 2012

(30) Foreign Application Priority Data

Dec. 18, 2008 (KR) ..... 10-2008-0129039

(51) Int. Cl.
*F01P 7/02* (2006.01)
*F01P 7/10* (2006.01)
*F04B 49/00* (2006.01)

(52) U.S. Cl.
USPC ..... 417/46; 123/41.11; 123/41.49; 60/484

(58) Field of Classification Search
USPC ..... 417/46; 123/41.11, 41.12, 41.48, 41.49; 60/456, 459, 484
See application file for complete search history.

(56) References Cited

U.S. PATENT DOCUMENTS

| | | | | |
|---|---|---|---|---|
| 3,992,883 | A * | 11/1976 | Cope | 60/456 |
| 4,036,432 | A * | 7/1977 | George | 236/35 |
| 5,975,233 | A * | 11/1999 | Eisenbacher | 180/417 |
| 6,076,488 | A * | 6/2000 | Yamagishi | 123/41.12 |
| 6,681,568 | B2 * | 1/2004 | Smith | 60/422 |
| 6,750,623 | B1 * | 6/2004 | McCauley et al. | 318/260 |
| 6,959,671 | B2 * | 11/2005 | Nakagawa et al. | 123/41.49 |
| 7,937,938 | B2 * | 5/2011 | Kuipers et al. | 60/456 |

FOREIGN PATENT DOCUMENTS

| | | | |
|---|---|---|---|
| KR | 840044 | B1 | 12/2001 |
| KR | 10-0338292 | B1 | 8/2002 |
| KR | 10-2006-0112340 | A | 11/2006 |
| KR | 10-2008-0057100 | A | 6/2008 |

OTHER PUBLICATIONS

Search Report dated Jun. 21, 2010 for International Application No. PCT/KR2009/007583, filed Dec. 18, 2009.

* cited by examiner

*Primary Examiner* — Peter J Bertheaud
(74) *Attorney, Agent, or Firm* — John D. Veldhuis-Kroeze; Westerman, Champlin & Koehler, P.A.

(57) ABSTRACT

A cooling device of a construction machine according to the present invention includes: two or more hydraulic motors that rotate positively and reversibly to correspond to a supplying direction of pressure oil and drives rotatably cooling fans connected thereto, respectively; a switching valve switching rotation directions of the two or more hydraulic motors by switching the supplying direction of the pressure oil supplied to the two or more hydraulic motors from the hydraulic motor; and flow rate makeup valves controlling an additional flow supplied upstream of the two or more hydraulic motors when a pressure drop is generated upstream of the two or more hydraulic motors on the basis of the supplying direction of the pressure oil.

4 Claims, 4 Drawing Sheets

COOLING DEVICE FOR CONSTRUCTION MACHINERY

This Application is a Section 371 National Stage Application of International Application No. PCT/KR2009/007583, filed Dec. 18, 2009 and published, not in English, as WO2010/071377 on Jun. 24, 2010.

FIELD OF THE DISCLOSURE

The present disclosure relates to a cooling device for a construction machine, and more particularly, to a cooling device that cools a radiator and an oil cooler of a construction machine by using a cooling fan.

BACKGROUND OF THE DISCLOSURE

In general, a construction machine such as a wheel loader or an excavator cools a radiator and an oil cooler placed in front thereof by forcibly sucking outdoor air through a cooling fan. However, in the case in which a hydraulic motor driving the cooling fan rotates (positively rotates) only in one direction at all times, dust is attached to the radiator and the like, thus, causing an inconvenience to an operator due to requiring periodic cleaning. Therefore, in recent years, a device has been used, which reversibly rotates the cooling fan by switching a rotation direction of the hydraulic motor through a switching valve to blow away dust accumulated by the blowing of the cooling fan.

In this connection, Korea Patent No. 840044 owned by an applicant discloses a driving control device of a cooling fan of construction heavy equipment. The disclosed driving control device includes a hydraulic pump, a hydraulic motor driven by pressure oil supplied from the hydraulic pump through a hydraulic line, and a cooling fan driven by the hydraulic motor. The hydraulic motor is configured by a hydraulic motor that rotates positively or reversibly. A switching valve that changes a supplying direction of the pressure oil and a switch electrically controlling the switching valve are provided on the hydraulic line connected from the hydraulic pump to the hydraulic motor.

In the related art, in general, a single cooling fan is adopted. However, in the case in which a plurality of cooling fans are provided in order to improve cooling efficiency, a plurality of switching valves need to be provided so as to change a rotation direction of each of the cooling fans, and as a result, the device becomes complicated and layout efficiency of parts deteriorates.

Further, when the cooling fan stops instantly in order for the cooling fan rotating positively or reversibly to change its rotation direction to the opposite direction or stop its operation by the switching valve, a sharp pressure drop region, i.e., a "cavity" is generated in the rear of the hydraulic motor, i.e., a point where the pressure oil is inputted into the hydraulic motor on the basis of a flowing direction of the pressure oil due to inertia. The cavity causes a large pressure difference in a mechanism, thereby deteriorating the performance of the hydraulic motor.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure is contrived to solve some or all problems of the related art. An object of the present disclosure is to provide a cooling device for a construction machine in which rotation directions of a plurality of cooling fans can be changed at the same time by a single switching valve.

Further, another object of the present disclosure is to provide a cooling device for a construction machine in which a pressure is automatically made up to a pressure drop region generated in the rear of a hydraulic motor at the time of changing directions.

In order to achieve the above-mentioned objects, a cooling device for a construction machine according to the present disclosure includes: two or more hydraulic motors that rotate positively and reversibly to correspond to a supplying direction of pressure oil and drives rotatably cooling fans 20*a* and 20*b* connected thereto, respectively; a switching valve 40 switching rotation directions of the two or more hydraulic motors by switching the supplying direction of the pressure oil supplied to the two or more hydraulic motors from the hydraulic motor 60; and flow rate makeup valves 50*a* and 50*b* controlling an additional flow supplied upstream of the two or more hydraulic motors when a pressure drop is generated upstream of the two or more hydraulic motors on the basis of the supplying direction of the pressure oil.

According to an exemplary embodiment of the present disclosure, the flow rate makeup valves may be constituted by two or more and make up the flow to each pressure drop region of the two or more hydraulic motors.

Further, the two or more flow rate makeup valves may receive the flow from an oil tank 70, and at least one of the two or more flow rate makeup valves may be installed on a hydraulic line L4 connecting a hydraulic line L1 connecting the switching valve 40 with the hydraulic pump 60 with the oil tank 70.

In addition, the cooling device may further include a hydraulic line L2 guiding the pressure oil drained from the switching valve 40 to the oil tank, and the hydraulic line L4 on which at least one of the two or more flow rate makeup valves is installed may be the hydraulic line connecting the hydraulic line L2 connecting the oil tank with the switching valve 40 and the hydraulic line L1 connecting the switching valve 40 with the hydraulic pump 60.

Meanwhile, the two or more flow rate makeup valves may receive the flow from the oil tank 70, and at least one of the two or more flow rate makeup valves may be installed on a hydraulic line L5 connecting the two or more hydraulic motors with the oil tank 70.

Further, the cooling device may further include the hydraulic line L2 guiding the pressure oil drained from the switching valve 40 to the oil tank, and the hydraulic line L5 on which at least one of the two or more flow rate makeup valves is installed may connect the hydraulic line L2 connecting the oil tank with the switching valve 40 and a hydraulic line L3 connecting the two or more hydraulic motors to each other.

According to a controlling device of a construction machine according to the present disclosure, there is an effect that rotation directions of a plurality of cooling fans are changed positively and reversibly at the same time by a single switching valve.

Further, according to the present disclosure, a pressure is made up by automatically providing makeup oil to a pressure drop region generated in the rear of a hydraulic motor when a direction is changed to prevent a mechanism from being damaged due to a pressure difference in the motor.

DETAILED DESCRIPTION

Hereinafter, exemplary embodiments of the present disclosure will be described in detail with reference to the accompanying drawings.

Figure 1:
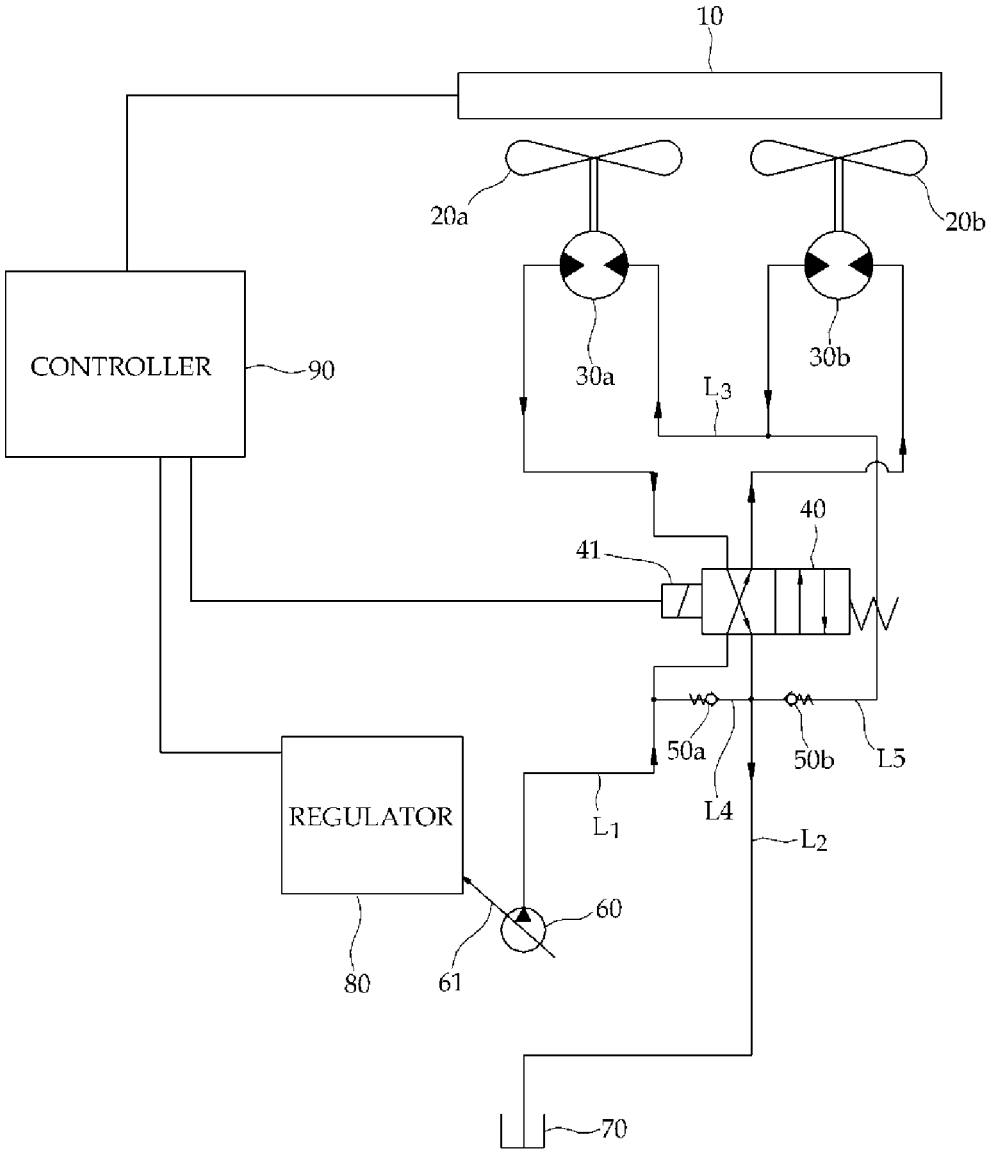
FIG. 1 is a hydraulic circuit diagram when a plurality of fans rotates positively in a cooling device of a construction machine according to an exemplary embodiment of the present disclosure.
Figure 2:
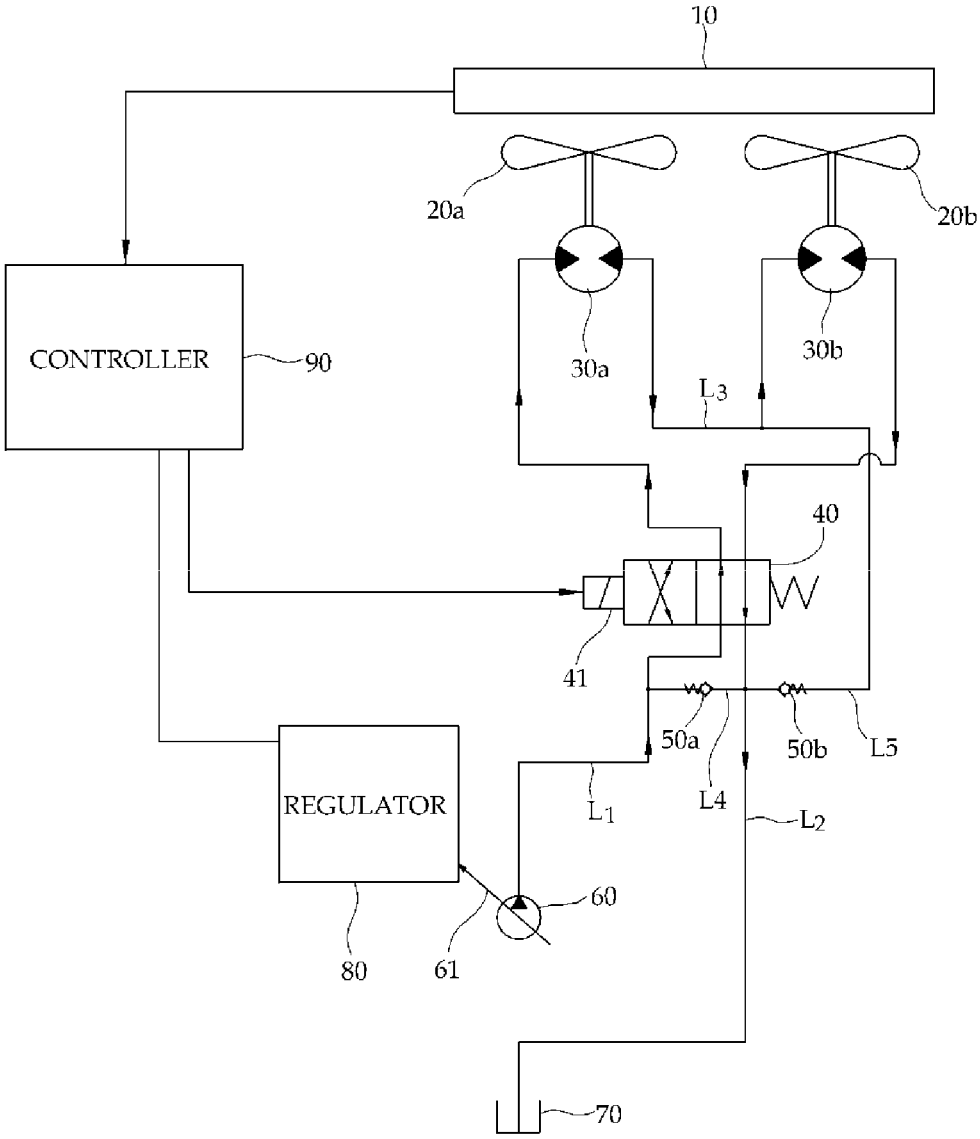
FIG. 2 is a hydraulic circuit diagram when a plurality of fans rotates reversibly in a cooling device of a construction machine according to an exemplary embodiment of the present disclosure.

FIG. 1 is a hydraulic circuit diagram when a plurality of cooling fans rotates positively in a cooling device of a construction machine according to an exemplary embodiment of the present disclosure and FIG. 2 is a hydraulic circuit diagram when a plurality of cooling fans rotates reversibly.

A cooling device of a construction machine according to an exemplary embodiment of the present disclosure is basically configured to cool a radiator and an oil cooler 10 by two cooling fans 20*a* and 20*b* as shown in FIGS. 1 and 2. The radiator and the oil cooler 10 are arranged on the side and may thus be cooled individually by each of the cooling fans 20*a* and 20*b* and placed in the front and rear, such that they may be cooled at the same time by two cooling fans 20*a* and 20*b*. Two cooling fans 20*a* and 20*b* are driven by two hydraulic motors 30*a* and 30*b*, respectively and two hydraulic motors 30*a* and 30*b* are connected in series by a hydraulic line.

A single switching valve 40 is provided on the hydraulic line connected from a hydraulic pump 60 to the hydraulic motors 30*a* and 30*b*. The switching valve 40 switches a supplying direction of pressure oil and supplies the pressure oil sequentially to two hydraulic motors 30*a* and 30*b* to change rotation directions of the hydraulic motors 30*a* and 30*b* positively or reversibly. In the exemplary embodiment, the switching valve 40 is a solenoid type and includes a solenoid unit 41 at one side thereof to receive a control signal from a controller 90.

A flow is supplied to the switching valve 40 by the hydraulic pump 60 driven by an engine or an electrical motor. The hydraulic pump 60 includes a swash plate 61 and has a configuration in which a discharged flow varies depending on an angle of the swash plate 61.

The flow is controlled by the controller 90. The controller 90 receives temperature signals from temperature sensors mounted on the radiator and the oil cooler 10 and controls the flow by judging rotation speeds of the cooling fans 20*a* and 20*b* required on the basis thereof. The controller 90 also transmits a positive-direction or reverse-direction rotation signal to the switching valve 40 through the solenoid valve 41. The reverse-direction rotation signal for cleaning may be set so that reverse-direction driving automatically occurs when a contamination level of the radiator 10 is higher than a predetermined level by detecting the contamination level of the radiator 10 or so that the reverse-direction driving occurs periodically at a predetermined time interval. Meanwhile, it may be configured so that the reverse-direction driving occurs manually by an additional external operation switch.

A regulator 80 is mounted between the controller 90 and the hydraulic pump 60 and adjusts the angle of the swash plate 61 of the hydraulic pump 60 to regulate a supply flow. The controller 80 may be configured to detect an actual flow supplied from the hydraulic pump 60 to feedback-control the pressure of the hydraulic pump 60.

Two flow rate makeup valves 50*a* and 50*b* are provided at a front end of the switching valve 40. Two flow rate makeup valves 50*a* and 50*b* make up the flow to each pressure drop region of two hydraulic motors 30*a* and 30*b* by raising the pressure oil from an oil tank 70. In the exemplary embodiment, a first flow rate makeup valve 50*a* is mounted between a first hydraulic line L1 connecting the switching valve 40 with the hydraulic pump 60 and a second hydraulic line L2 connecting the switching valve 40 with the oil tank 70. That is, the first flow rate makeup valve 50*a* is installed on a hydraulic line L4 connecting the first hydraulic line L1 and the second hydraulic line L2. Meanwhile, a second flow rate makeup valve 50*b* is mounted between the second hydraulic line L2 connecting the switching valve 40 with the oil tank 70 and a third hydraulic line L3 connecting two hydraulic motors 30*a* and 30*b*. That is, the second flow rate makeup valve 50*b* is installed on a hydraulic line L5 connecting the second hydraulic line L2 and the third hydraulic line L3.

Hereinafter, the flow of the pressure oil for each rotational state and the flow of the makeup oil when the rotation direction is changed will be described with reference to the accompanying drawings.

Figure 3:
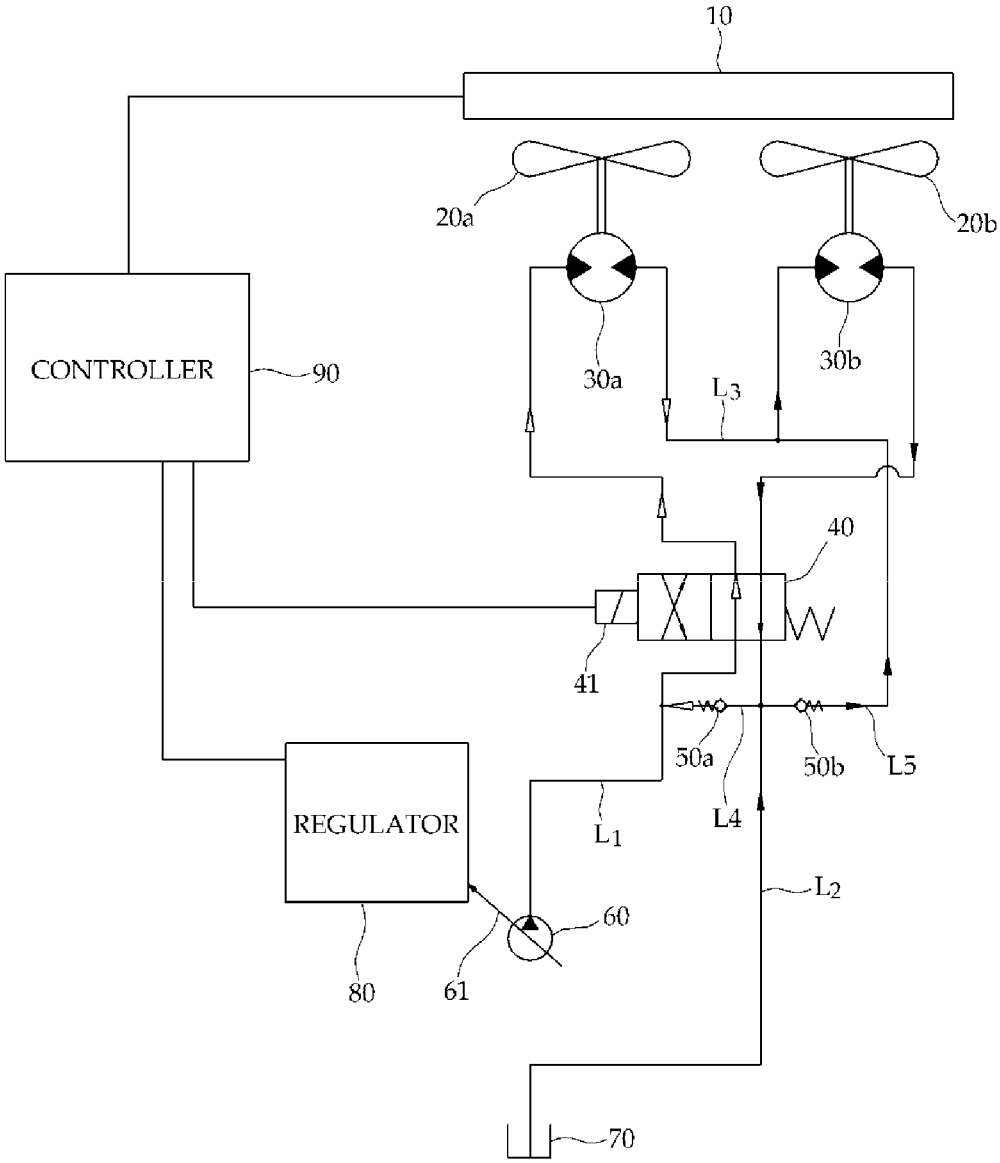
FIG. 3 is a hydraulic circuit diagram showing the flow of makeup oil when a plurality of fans rotates positively and thereafter, stop in a cooling device of a construction machine according to an exemplary embodiment of the present disclosure.
Figure 4:
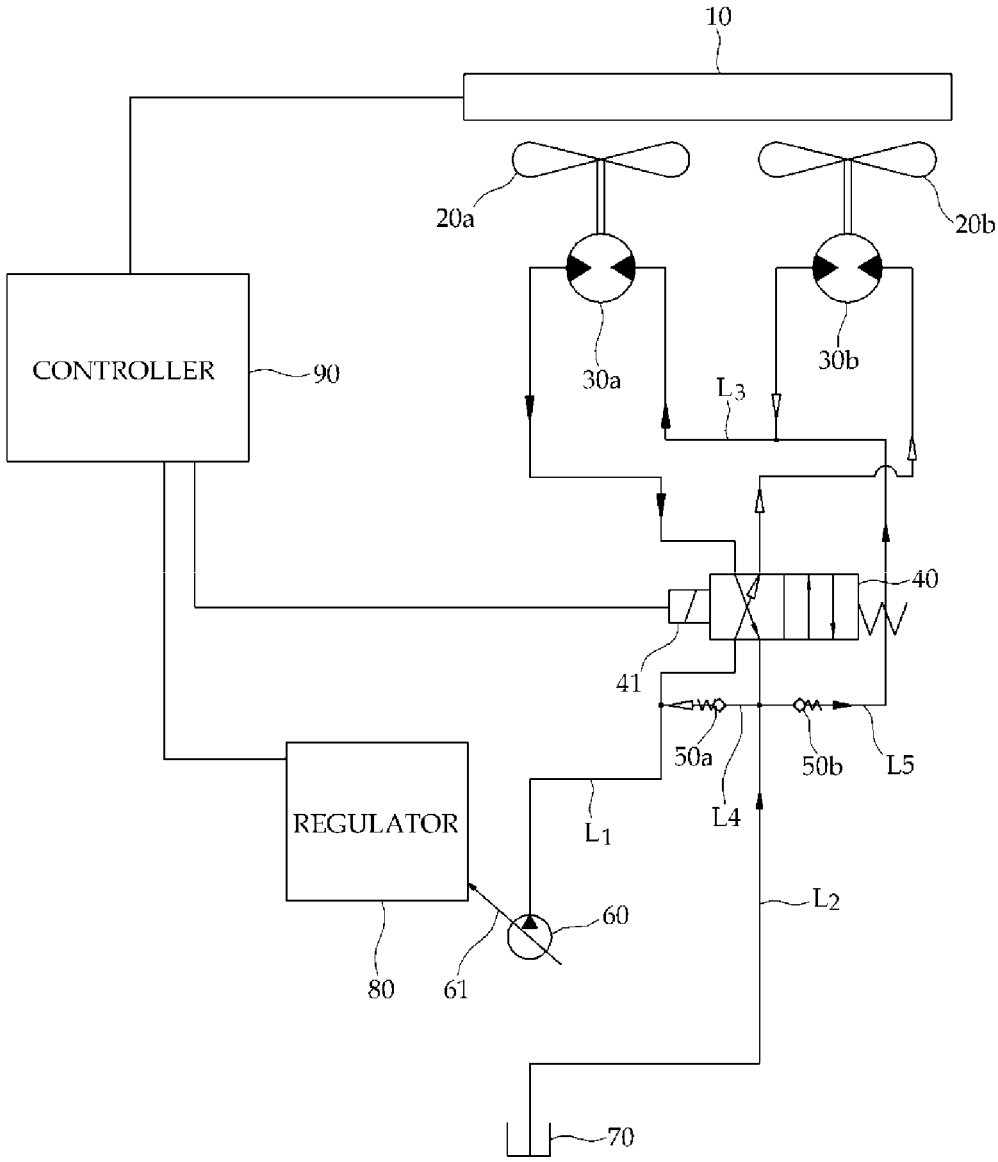
FIG. 4 is a hydraulic circuit diagram showing the flow of makeup oil when a plurality of fans rotates reversibly and thereafter, stop in a cooling device of a construction machine according to an exemplary embodiment of the present disclosure.

FIG. 3 is a hydraulic circuit diagram showing the flow of makeup oil when a plurality of cooling fans rotates positively and thereafter, stop in a cooling device of a construction machine according to an exemplary embodiment of the present disclosure and FIG. 4 is a hydraulic circuit diagram showing the flow of makeup oil when a plurality of cooling fans rotates reversibly and thereafter, stop.

As shown in FIG. 1, in the case in which the cooling fans 20*a* and 20*b* rotate positively to cool the radiator and the oil cooler 10, the flow supplied from the hydraulic pump 60 passes through the switching valve 40 and a first hydraulic motor 30*a* and thereafter, is supplied to a second hydraulic motor 30*b* and passes through the switching valve 40 again to be discharged to the oil tank 70.

In the case in which the cooling fans 20*a* and 20*b* rotating positively stop instantly for reverse rotation or operational stop, the flow of the flow supplied from the hydraulic pump 60 stops and a sharp pressure drop region, i.e., a "cavity" is generated in the rear of the hydraulic motors 30*a* and 30*b*, i.e., a point (a left side of each hydraulic motor in the figure) where the pressure oil is inputted into each of the hydraulic motors 30*a* and 30*b* on the basis of a flowing direction of the pressure oil due to inertia. A pressure difference is generated between each of the hydraulic motors 30*a* and 30*b* and the oil tank 70 due to the generation of the pressure drop region, and as a result, as shown in FIG. 3, a part of the flow discharged to the oil tank 70, that is, the makeup oil is drawn. The makeup oil is distributed to the left and right by the flow rate makeup valves 50*a* and 50*b* in the figure and thus a left flow (--▷) is supplied to the rear of the first hydraulic motor 30*a* through the switching valve 40 and a right flow (--►) is supplied to the rear of the second hydraulic motor 30*a* through an additional supply line. The supply of the makeup oil to the rear of each of the hydraulic motors 30*a* and 30*b* removes an instant pressure difference in the motor to prevent a mechanism from being damaged.

Meanwhile, as shown in FIG. 2, in the case in which the cooling fans 20*a* and 20*b* rotate reversibly to clean the radiator and the oil cooler 10, the flow supplied from the hydraulic pump 60 passes through the switching valve 40 and the second hydraulic motor 30*b* and thereafter, is supplied to the second hydraulic motor 30*a* and passes through the switching valve 40 again to be discharged to the oil tank 70.

In the case in which the cooling fans 20*a* and 20*b* rotating reversibly stop instantly for positive rotation or operational stop, the flow of the flow supplied from the hydraulic pump 60 stops and a sharp pressure drop region is generated at a point (a right side of each hydraulic motor in the figure) where the pressure oil is inputted into each of the hydraulic motors 30*a* and 30*b* on the basis of the flowing direction of the pressure oil due to inertia. The pressure difference is generated between each of the hydraulic motors 30*a* and 30*b* and the oil tank 70 due to the generation of the pressure drop region, and as a result, as shown in FIG. 4, the makeup oil is drawn from the oil tank 70. The makeup oil is distributed to the left and right by the flow rate makeup valves 50*a* and 50*b* in the figure and thus a left flow (--▷ ) is supplied to the rear of the second hydraulic motor 30*b* through the switching valve 40 and a right flow (--▶ ) is supplied to the rear of the first hydraulic motor 30*a* through an additional supply line. The supply of the makeup oil to the rear of each of the hydraulic motors 30*a* and 30*b* removes the instant pressure difference in the motor to prevent the mechanism from being damaged.

Meanwhile, although the present disclosure has been described with reference to the exemplary embodiments shown in the figures, it is merely exemplary and it is to be understood by those skilled in the art that various modifications and equivalent exemplary embodiments are possible therefrom. Therefore, the scope of the present disclosure will be determined by the appended claims.

The present disclosure can be applied to all construction machines in which a cooling fan is driven by a hydraulic motor in addition to an excavator or a wheel loader.

The invention claimed is:

1. A cooling device for a construction machine, comprising:

two or more hydraulic motors that rotate positively and reversibly to correspond to a supplying direction of pressure oil and drives rotatably cooling fans connected thereto, respectively;

a switching valve switching rotation directions of the two or more hydraulic motors and by switching the supplying direction of the pressure oil supplied to the two or more hydraulic motors from a hydraulic pump; and two or more flow rate makeup valves controlling an additional flow supplied upstream of the two or more hydraulic motors when a pressure drop is generated upstream of the two or more hydraulic motors on the basis of the supplying direction of the pressure oil;

wherein the flow rate makeup valves make up the flow to each pressure drop region of the two or more hydraulic motors;

wherein the two or more flow rate makeup valves receive the flow from an oil tank;

at least one of the two or more flow rate makeup valves is installed on a hydraulic line L4 connecting a hydraulic line L1, which connects the switching valve with the hydraulic pump, with the oil tank; and at least the other of the two or more flow rate makeup valves is installed on a hydraulic line L5 connecting the two or more hydraulic motors with the oil tank.

2. The device of claim 1, further comprising:

a hydraulic line L2 guiding the pressure oil drained from the switching valve to the oil tank, wherein the hydraulic line L4 on which at least one of the two or more flow rate makeup valves is installed is the hydraulic line connecting the hydraulic line L2, which connects the oil tank with the switching valve, and the hydraulic line L1 connecting the switching valve with the hydraulic pump.

3. The device of claim 1, further comprising:

the hydraulic line L2 guiding the pressure oil drained from the switching valve to the oil tank, wherein the hydraulic line L5 on which at least one of the two or more flow rate makeup valves is installed connects the hydraulic line L2, which connects the oil tank with the switching valve, and a hydraulic line L3 connecting the two or more hydraulic motors to each other.

4. The device of claim 1, further comprising:

a controller configured to change the rotation directions of the two or more hydraulic motors when a contamination level of the radiator is higher than a predetermined level or when a predetermined time interval is elapsed or when receives a signal by operating to a certain switch.

* * * * *